US005215487A

United States Patent [19]

Gruber

[11] Patent Number: 5,215,487

[45] Date of Patent: Jun. 1, 1993

[54] MARINE PROPULSION DEVICE WATER INLET SCREEN

[75] Inventor: Erick L. Gruber, Waukegan, Ill.

[73] Assignee: Outboard Marine Corporation, Waukegan, Ill.

[21] Appl. No.: 823,293

[22] Filed: Jan. 21, 1992

[51] Int. Cl.[5] ..... B63H 21/38

[52] U.S. Cl. ..... 440/88; 440/900

[58] Field of Search ..... 440/76, 78, 88, 89, 440/900; 123/195 P

[56] References Cited

U.S. PATENT DOCUMENTS

| | | | |
|---|---|---|---|
| 4,752,257 | 6/1988 | Karls et al. | 440/76 |
| 4,767,366 | 8/1988 | Lang | 440/76 |
| 4,861,293 | 8/1989 | McGowan et al. | 440/76 |
| 4,954,109 | 9/1990 | McMorries, IV | 440/78 |
| 5,098,322 | 3/1992 | Higby | 440/88 |

*Primary Examiner*—Jesus D. Sotelo

*Attorney, Agent, or Firm*—Michael, Best & Friedrich

[57] ABSTRACT

A marine propulsion device comprising a housing including a side wall having therein a water inlet and having an outer surface which extends generally in the fore and aft direction and which includes a ramped portion having a forward end and sloping rearwardly and outwardly from the inlet, and a forwardly-facing portion partially defining the inlet and extending inwardly from the forward end of the ramped portion, a water inlet screen covering the inlet and including an inner surface which slopes rearwardly and outwardly and which engages the ramped surface portion of the housing, screws for securing the screen to the housing, and a propeller shaft rotatably supported by the housing.

15 Claims, 1 Drawing Sheet

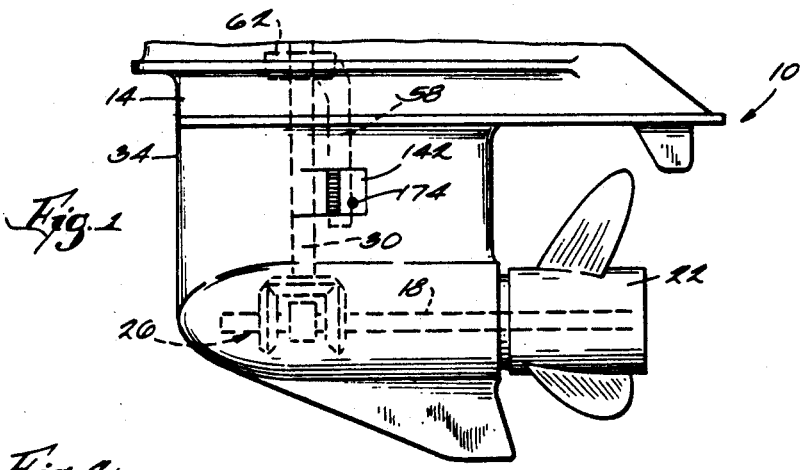
Fig. 1
Fig. 2.
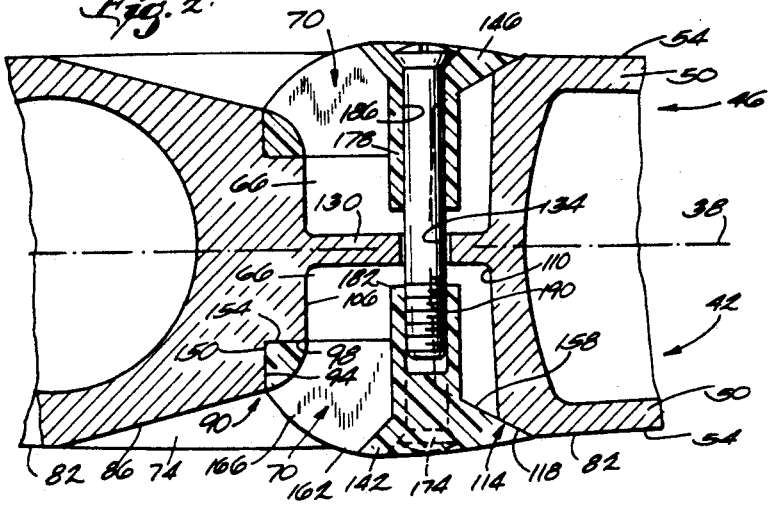
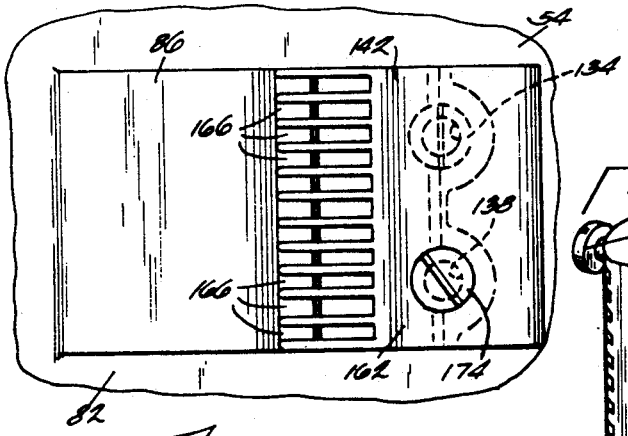
Fig. 3
Fig. 4
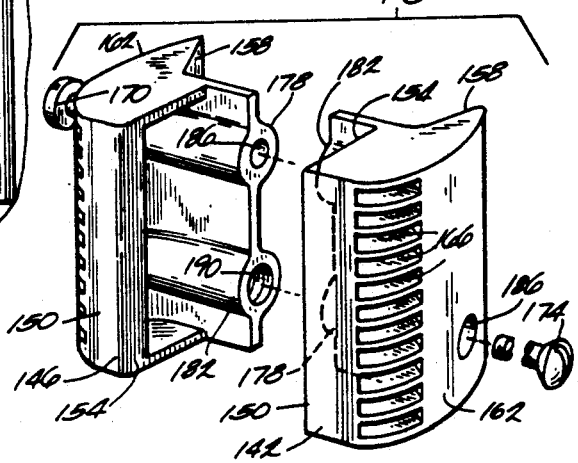

MARINE PROPULSION DEVICE WATER INLET SCREEN

BACKGROUND OF THE INVENTION

The invention relates generally to marine propulsion devices, such as outboard motors and stern drive units.

More particularly, the invention relates to cooling water inlets in the gear case of such marine propulsion devices and to screened cooling water inlets for marine propulsion devices.

Attention is directed to the following prior art United States patents:

| | | |
|---|---|---|
| McMorries, IV | 4,954,109 | September 4, 1990 |
| McGowan et al. | 4,861,293 | August 29, 1989 |
| Lang | 4,767,366 | August 30, 1988 |
| Karls et al. | 4,752,257 | June 21, 1988 |

SUMMARY OF THE INVENTION

The invention provides a marine propulsion device comprising a housing including a side wall having therein a water inlet and having an outer surface which extends generally in the fore and aft direction and which includes a ramped portion having a forward end and sloping rearwardly and outwardly from the inlet, and a forwardly-facing portion partially defining the inlet and extending inwardly from the forward end of the ramped portion, a water inlet screen covering the inlet and including an inner surface which slopes rearwardly and outwardly and which engages the ramped surface portion of the housing, means for securing the screen to the housing, and a propeller shaft rotatably supported by the housing.

The invention also provides a marine propulsion device comprising a housing including a side wall having therein a water inlet and having an outer surface extending generally in the fore and aft direction, a water inlet screen covering the water inlet and having a rearward end adjacent the outer surface of the housing, means for securing the screen to the housing, and means for providing a smooth transition between the rearward end of the screen and the outer surface of the housing while allowing variation of the location of the rearward end of the screen relative to the outer surface of the housing.

The invention also provides an outboard motor comprising a lower unit including a side wall having therein a water inlet and having an outer surface, the outer surface including a main portion extending generally in the fore and aft direction, a first portion having a rearward end and sloping rearwardly and inwardly toward the inlet, a second portion facing rearwardly and extending inwardly from the rearward end of the first portion, a third portion facing outwardly and extending rearwardly from the second portion, a fourth portion facing rearwardly, extending inwardly from the third portion, and partially defining the inlet, a fifth portion facing the fourth portion, having an outer end, and partially defining the inlet, and a ramped portion sloping rearwardly and outwardly from the outer end of the fifth portion, the ramped surface portion and the first, second and third surface portions defining a recess in the main portion, a water inlet screen covering the inlet and including a front end surface engaging the second surface portion, a front inner surface engaging the third surface portion, and a rear inner surface which slopes rearwardly and outwardly and which engages the ramped surface portion of the lower unit, means for securing the screen to the lower unit, and a propeller shaft rotatably supported by the lower unit.

Prior art water inlets and water inlet screens are generally constructed to require tight manufacturing tolerances. See for example prior art U.S. Pat. No. 4,861,293. These tolerances can make it difficult to consistently install the screen insert flush with the surface of the gear case.

The invention provides the advantage of reducing the sensitivity of the inlet screen to manufacturing tolerances. This is accomplished by providing a ramped surface at the rearward edge of the water inlet. The ramped surface extends outwardly and rearwardly from the water inlet. The trailing edge of the water inlet screen is tapered at the same angle as the ramped surface. The fit provided by the tapered surface engaging the ramped surface is nearly flush, thereby minimizing the flow disturbance around the gear case.

Other features and advantages of the invention will become apparent to those skilled in the art upon review of the following description, claims and drawings.

BRIEF DESCRIPTION OF THE DRAWINGS

FIG. 1 is a partial side elevational view of a marine propulsion device embodying the invention.

FIG. 2 is a view taken along line 2—2 in FIG. 1.

FIG. 3 is an enlarged portion of FIG. 1.

FIG. 4 is an enlarged, exploded perspective view of the water inlet screen assembly.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Shown in FIG. 1 of the drawings is a portion of a lower unit 10 of a marine propulsion device which can either be an outboard motor or a stern-drive unit. The portion of the lower unit shown in FIG. 1 comprises a gear case or housing 14 which supports a propeller shaft 18 that carries a propeller 22 and that is connected via a reversing transmission 26 with a drive shaft 30 driven by an engine (not shown). The gear case 14 has a leading edge 34 and is generally symmetrical on each side of a centerline 38 (FIG. 2) which divides the gear case into left and right or port and starboard half-sections 42 and 46, respectively, and which intersects the leading edge 34. Each of the half-sections is comprised of a side wall 50 having an outer surface 54 which extends rearwardly from the leading edge 34 and which is outwardly convex toward a maximum dimension transversely of, or perpendicular to, the centerline 38.

The gear case 14 includes (see FIG. 1) an interior hollow conduit 58 or passage leading to the intake of a water pump 62 for supplying cooling water to the engine of the marine propulsion device. The conduit or passage includes (see FIG. 2), in each of the half-sections 42 and 46, respective branch passages or openings 66 extending through the gear case outer surfaces and in part, forming respective water inlets 70.

As the construction is identical in both half-sections, only the half-section 42 will be described in detail. In this regard, the opening is defined by the outer surface 54 of the side wall 50. An upper horizontally extending portion (not shown) and a lower horizontally extending portion 74 (shown in FIG. 2) of the outer surface 54 define the upper and lower limits of the water inlet 70. The outer surface 54 includes (see FIG. 2) a main portion 82 which extends generally in the fore and aft direction from the leading edge 34. The outer surface 54 also includes a first portion 86 having a rearward end 90 and sloping rearwardly and inwardly from the main portion 82. A second portion 94 of the outer surface 54 faces rearwardly, that is, away from the leading edge 34, and extends inwardly from the rearward end 90 of the first portion 86 of the outer surface. A third portion 98 of the outer surface faces outwardly and extends rearwardly from the second portion 94. A fourth portion 106 of the outer surface 54 faces rearwardly and extends inwardly from the rearward end of the third portion 98. A fifth portion 110 of the outer surface 54 faces forwardly, that is, faces the fourth portion 106 of the outer surface and includes an outer end 114. Together, the surface portions 106 and 110 form the main vertical side walls of and thus partially define the water inlet 70. The outer surface 54 also includes a ramped portion 118 which slopes rearwardly and outwardly from the outer end 114 of the surface portion 110. In other words, the ramped portion 118 has a forward end (coincident with the outer end 114 of the surface portion 110), and the surface portion 110 extends inwardly from the forward end of the ramped portion 118. The previously discussed surface portions 82, 86, 94, 98, 106, 110 and 118 extend throughout the vertical extent of the inlet 70 and define a recess in the main portion 82.

Extending between the surface portions 106 and 110 of both half-sections 42 and 46 is a wall 130 defining the innermost extent of both inlets 70. The wall 130 has therethrough (see FIGS. 2 and 3) upper and lower bores 134 and 138, respectively, the reason for which is explained below.

A port screen 142 is located in the port inlet 70 and a starboard screen 146 is located in the starboard inlet 70. Each of the screens 142 and 146 is fabricated from plastic, steel, or another suitable material. The screens 142 and 146 are substantially identical, and only the port screen 142 is described below. The screen 142 includes (see FIG. 2) a front end surface 150 facing forwardly and engaging the gear case surface portion 94, and a front inner surface 154 extending rearwardly from the front end surface 150 and engaging the gear case surface portion 98. The screen 142 also includes a rear inner surface 158 which slopes rearwardly and outwardly and which is complementary with and engages the ramped surface portion 118 of the gear case.

The screen 142 also includes an arcuate outer surface 162 which curves outwardly and which extends from the outer end of the front end surface 150 (the lower end in FIG. 2) to the rearward end of the rear inner surface 158 (the right end in FIG. 2). A series of water inlet slots 166 (FIGS. 2–4) extend horizontally throughout the width of the water inlet screen 142 and between the outer surface 162 and the front inner surface 154. These slots 166 allow water to enter the water inlet 70 but substantially prevent entry of debris which may clog the water inlet or the water pump 62.

Any suitable means can be employed for fixedly attaching the screens 142 and 146 to the gear case. In the disclosed construction, the screens are connected to each other and to the gear case by upper and lower screws 170 and 174, respectively. In this regard, each screen includes, on the inside thereof, bosses 178 and 182. The boss 178 includes a through bore 186 and the boss 182 includes a blind bore 190 open from the inside. In assembly, the screens 142 and 146 are inserted into the inlets 70 with the result that on the port side (i.e., the side shown in FIG. 1 and the bottom side in FIG. 2), the screen 142 is positioned so that the boss 178 is located below the boss 182. On the starboard side (i.e., the top side in FIG. 2), the screen 146 is positioned so that the boss 178 is located above the boss 182. The lower screw 174 is then inserted through the bore 182 in the port screen 142 and through the lower gear case bore 138 and is threaded into the blind bore 190 in the starboard screen 146. The upper screw 170 is inserted through the bore 182 in the starboard screen and through the upper gear case bore 134 and is threaded into the blind bore 190 in the port screen 142.

The ramped surfaces 158 on the screens and the ramped surfaces 118 on the gear case provide a smooth transition between the rearward ends of the screens 142 and 146 and the outer surface 54 of the gear case while allowing variation of the location of the rearward ends of the screens relative to the outer surface of the gear case and variation of the distance between the rearward ends of the screens and the centerline 38. In other words, the water inlet screens 142 and 146 have reduced sensitivity to manufacturing tolerances. This is because a generally flush surface is created where the trailing edge of each water inlet screen 142 and 146 engages the associated ramped surface portion 118 of the lower unit 10. The generally flush surface is created regardless of the fact that the front end surface 150 of each screen consistently engages the associated surface portion 94 of the gear case in the same fashion. Furthermore, the flush surface is created irrespective of variations in the distance between the front end surface 150 and the trailing edge of the screen 142 or 146. Variations in this distance may be created in the manufacturing process and are usually a result of loose manufacturing tolerances. The existence of the generally flush surface created by the invention minimizes the flow disturbance created by the junction between the screen and the gear case.

Various features of the invention are set forth in the following claims.

I claim:

1. A marine propulsion device comprising a housing including a side wall having therein a water inlet and having an outer surface which extends generally in the fore and aft direction and which includes a ramped portion having a forward end and sloping rearwardly and outwardly from said inlet, and a forwardly-facing portion partially defining said inlet and extending inwardly from said forward end of said ramped portion, a water inlet screen covering said inlet and including an inner surface which slopes rearwardly and outwardly and which engages said ramped surface portion of said housing, means for securing said screen to said housing, and a propeller shaft rotatably supported by said housing.

2. A marine propulsion device as set forth in claim 1 wherein said outer surface includes a main portion extending generally in the fore and aft direction, and wherein said ramped surface portion partially defines a recess in said main portion.

3. A marine propulsion device as set forth in claim 2 wherein said ramped surface portion has a forward end, wherein said outer surface also includes a first portion having a rearward end and sloping rearwardly and inwardly from said main portion, a second portion facing rearwardly and extending inwardly from said rearward end of said first portion, a third portion facing outwardly and extending rearwardly from said second portion, and a fourth portion facing said forwardly-facing portion, extending inwardly from said third portion, and partially defining said inlet, and wherein said screen includes a front end surface engaging said second surface portion and a front inner surface engaging said third surface portion.

4. A marine propulsion device as set forth in claim 3 wherein said ramped surface portion and said first, second and third surface portions define a recess in said main portion.

5. A marine propulsion device as set forth in claim 1 wherein said housing includes an opposite side wall having therein an opposite water inlet, wherein said marine propulsion device further comprises an opposite inlet screen covering said opposite water inlet, and wherein said means for securing said first-mentioned inlet screen to said housing includes means connecting said first-mentioned inlet screen to said opposite inlet screen.

6. A marine propulsion device as set forth in claim 5 wherein said connecting means includes a screw extending through said first-mentioned inlet screen and threaded into said opposite inlet screen, and a screw extending through said opposite inlet screen and threaded into said first-mentioned inlet screen.

7. A marine propulsion device as set forth in claim 6 wherein said first-mentioned inlet screen and said opposite inlet screen are substantially identical.

8. A marine propulsion device as set forth in claim 1 and further comprising a water pump having an inlet communicating with said water inlet.

9. A marine propulsion device comprising a housing including a side wall having therein a water inlet and having an outer surface extending generally in the fore and aft direction, said housing having a center line extending in the fore and aft direction, a water inlet screen covering said water inlet and having rearward end adjacent said outer surface of said housing, means for securing said screen to said housing, and means for providing a smooth transition between said rearward end of said screen and said outer surface of said housing while allowing variation of the location of said rearward end of said screen relative to said outer surface of said housing, and allowing variation of the distance between said rearward end of said screen and said center line.

10. A marine propulsion device as set forth in claim 9 wherein said providing means includes, on said outer surface, a ramped portion sloping rearwardly and outwardly from said inlet, and, on said screen, an inner surface which slopes rearwardly and outwardly and which engages said ramped surface portion of said housing.

11. An outboard motor comprising a lower unit including a side wall having therein a water inlet and having an outer surface, said outer surface including a main portion extending generally in the fore and aft direction, a first portion having a rearward end and sloping rearwardly and inwardly toward said inlet, a second portion facing rearwardly and extending inwardly from said rearward end of said first portion, a third portion facing outwardly and extending rearwardly from said second portion, a fourth portion facing rearwardly, extending inwardly from said third portion, and partially defining said inlet, a fifth portion facing said fourth portion, having an outer end, and partially defining said inlet, and a ramped portion sloping rearwardly and outwardly from said outer end of said fifth portion, said ramped surface portion and said first, second and third surface portions defining a recess in said main portion, a water inlet screen covering said inlet and including a front end surface engaging said second surface portion, a front inner surface engaging said third surface portion, and a rear inner surface which slopes rearwardly and outwardly and which engages said ramped surface portion of said lower unit, means for securing said screen to said lower unit, and a propeller shaft rotatably supported by said lower unit.

12. An outboard motor as set forth in claim 11 wherein said lower unit includes an opposite side wall having therein an opposite water inlet, wherein said marine propulsion device further comprises an opposite inlet screen covering said opposite water inlet, and wherein said means for securing said first-mentioned inlet screen to said lower unit includes means connecting said first-mentioned inlet screen to said opposite inlet screen.

13. An outboard motor as set forth in claim 12 wherein said connecting means includes a screw extending through said first-mentioned inlet screen and threaded into said opposite inlet screen, and a screw extending through said opposite inlet screen and threaded into said first-mentioned inlet screen.

14. An outboard motor as set forth in claim 13 wherein said first-mentioned inlet screen and said opposite inlet screen are substantially identical.

15. An outboard motor as set forth in claim 14 and further comprising a water pump having an inlet communicating with said water inlet.

* * * * *